US007100480B2

(12) United States Patent
Engvall et al.

(10) Patent No.: US 7,100,480 B2
(45) Date of Patent: Sep. 5, 2006

(54) QUICK ADJUSTING PLIERS

(75) Inventors: David P. Engvall, Beatrice, NE (US); Jeffery L. Ditzler, Lincoln, NE (US); Gene L. Tyser, Wilbur, NE (US)

(73) Assignee: Irwin Industrial Tool Company, Huntersville, NC (US)

( * ) Notice: Subject to any disclaimer, the term of this patent is extended or adjusted under 35 U.S.C. 154(b) by 0 days.

(21) Appl. No.: 10/406,621

(22) Filed: Apr. 2, 2003

(65) Prior Publication Data

US 2004/0194590 A1 Oct. 7, 2004

(51) Int. Cl.
*B25B 7/04* (2006.01)

(52) U.S. Cl. ..... 81/413; 81/391; 81/392

(58) Field of Classification Search ..... 81/407–409, 81/409.5, 405, 413–414, 391–393, 352–360, 81/347; 269/212, 215
See application file for complete search history.

(56) References Cited

U.S. PATENT DOCUMENTS

| | | | |
|---|---|---|---|
| 2,727,417 | A | 12/1955 | Eifel |
| 3,176,551 | A | 4/1965 | Hansen |
| 3,192,805 | A | 7/1965 | Manning |
| 4,232,573 | A | 11/1980 | Dace, Jr. |
| 4,296,655 | A | 10/1981 | Tesoro |
| 4,438,669 | A | 3/1984 | Hastings et al. |
| 4,603,607 | A | 8/1986 | Schaffner, Jr. |
| 4,662,252 | A | 5/1987 | Warheit |
| 4,719,827 | A | 1/1988 | Igarashi |
| 4,753,140 | A | 6/1988 | Majima |
| 4,893,530 | A | 1/1990 | Warheit |
| 4,901,609 | A | 2/1990 | Crum |
| 4,922,770 | A | 5/1990 | Dlugolecki et al. |
| 5,060,543 | A | 10/1991 | Warheit |
| 5,134,908 | A | 8/1992 | Fisher |
| 5,351,584 | A | 10/1994 | Warheit |
| 5,660,089 | A | 8/1997 | Chow |
| 5,850,768 | A | 12/1998 | Chow |
| 6,000,303 | A | 12/1999 | Chang |
| 6,019,020 | A | 2/2000 | Liou |
| 6,101,908 | A | 8/2000 | Azkona |
| 6,161,455 | A | 12/2000 | Ping |
| 6,199,458 | B1 | 3/2001 | Wrigley et al. |
| 6,199,459 | B1 | 3/2001 | Azkona |
| 6,212,978 | B1 | 4/2001 | Seber et al. |
| 6,227,081 | B1 | 5/2001 | Bally et al. |
| 6,279,431 | B1 | 8/2001 | Seber et al. |
| 6,311,588 | B1 | 11/2001 | St. John et al. |
| 6,318,217 | B1 | 11/2001 | Emhardt et al. |
| 6,327,943 | B1 | 12/2001 | Wrigley et al. |
| 6,378,404 | B1 | 4/2002 | Bally et al. |
| 6,467,380 | B1 | 10/2002 | Azkona |
| 2002/0139227 | A1 | 10/2002 | Azkona |

FOREIGN PATENT DOCUMENTS

| | | | |
|---|---|---|---|
| DE | 199 63 818 | A1 | 7/2001 |
| GB | 27941 | | 7/1914 |
| GB | 2 166 382 | A | 5/1986 |
| GB | 2 334 913 | A | 9/1999 |
| WO | WO 99/44790 | A1 | 9/1999 |

OTHER PUBLICATIONS

Pending U.S. Appl. 10/718,782, filed Nov. 21, 2003, by Engvall et al.

*Primary Examiner*—Debra S. Meislin
(74) *Attorney, Agent, or Firm*—Dennis J. Williamson; Moore and VanAllen, PLLC

(57) ABSTRACT

A method and device is disclosed for clamping an object with quick adjusting pliers. A top jaw has a bottom handle, a slot, and a series of ridges located around the slot. A pin extends through the slot. A tongue element has a first opening for receiving the pin. A bottom jaw has a top handle and another opening for receiving the pin, wherein the tongue element engages one of the series of ridges, and wherein the top jaw and bottom jaw pivot about a first axis that extends though a longitudinal axis of the pin, and wherein the tongue element is moveable relative to the ridges to allow for engagement or disengagement with said ridges.

25 Claims, 8 Drawing Sheets

QUICK ADJUSTING PLIERS

BACKGROUND OF THE INVENTION

This invention relates generally to pliers devices, and more particularly, to pliers devices that can be quickly adjusted to several positions.

SUMMARY OF THE INVENTION

The present invention provides a device and method for clamping an object with quick adjusting pliers. In particular, a device is provided with a top jaw having a bottom handle, a slot, and a series of ridges located around the slot. A pin is provided for extending through the slot. A tongue element is also provided with a first opening for receiving the pin. In addition, a bottom jaw is provided with a top handle and another opening for receiving the pin. The tongue element engages one of the series of ridges. The top jaw and bottom jaw pivot about a first axis of the pin, and the tongue element is moveable relative to the series of ridges to allow for engagement or disengagement of the ridges.

In one embodiment of the invention, the ridges are straight.

In another embodiment of the invention, the ridges are curved.

These and other features of the invention will become apparent upon review of the following detailed description of the presently preferred embodiments of the invention, taken into conjunction with the appended figures.

DETAILED DESCRIPTION OF THE PREFERRED EMBODIMENTS

Figure 1:
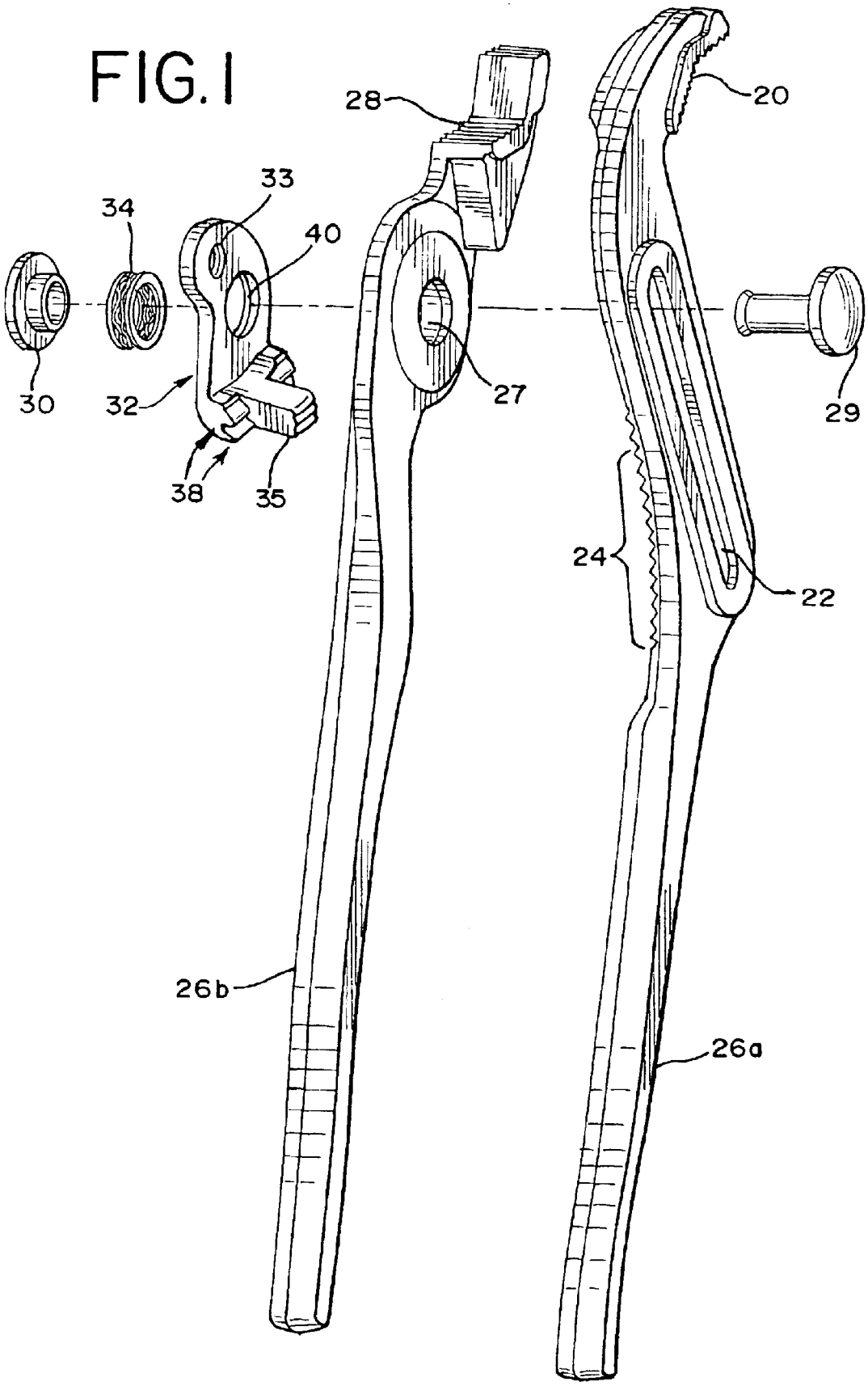
FIG. 1 is an exploded view of a quick adjusting pliers device according to a first embodiment of the present invention.
Figure 2:
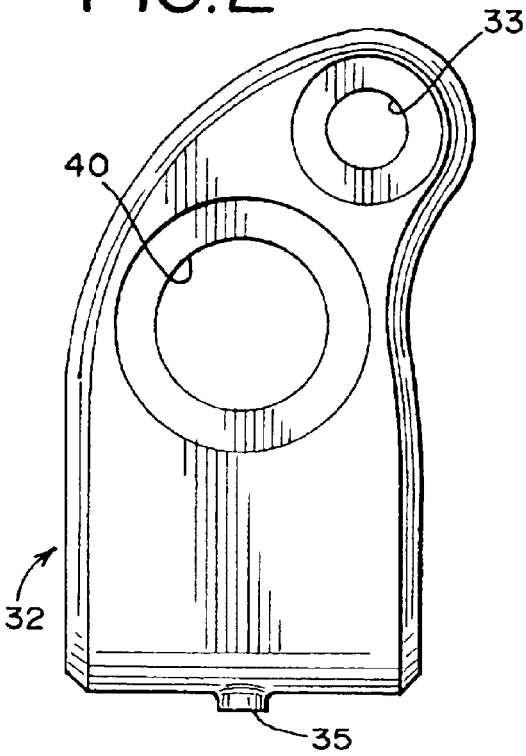
FIG. 2 is a top view of the tongue element of the quick adjusting pliers device of FIG. 1.
Figure 3:
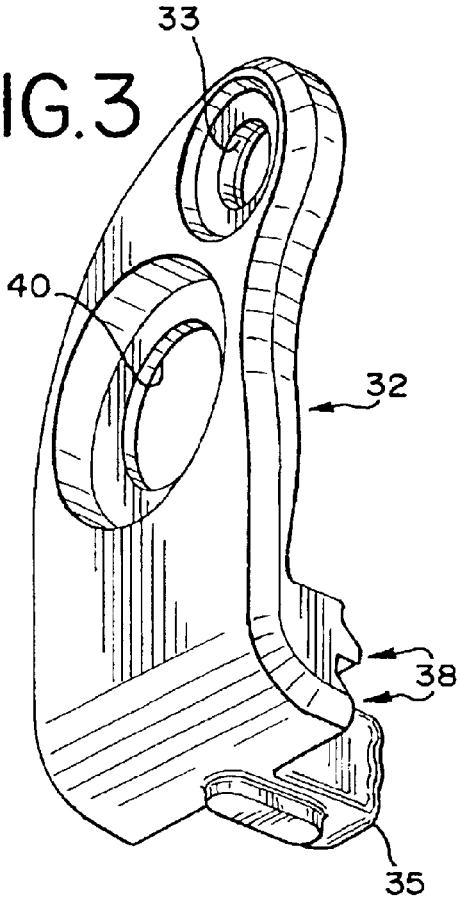
FIG. 3 is a perspective top view of the tongue element of the quick adjusting pliers device of FIG. 1.
Figure 4:
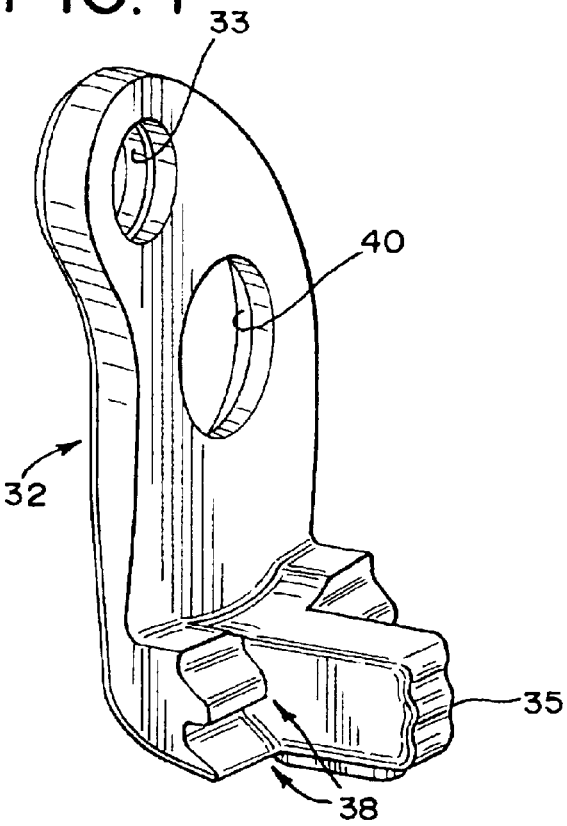
FIG. 4 is a perspective bottom view of the tongue element of the quick adjusting pliers device of FIG. 1.
Figure 5:
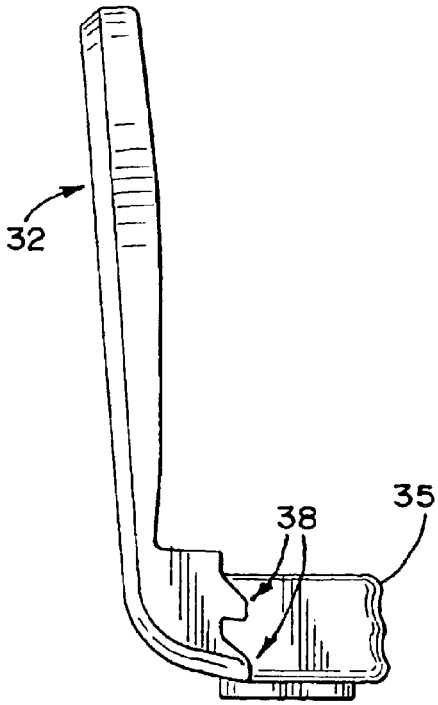
FIG. 5 is a left side view of the tongue element of the quick adjusting pliers device of FIG. 1.
Figure 6:
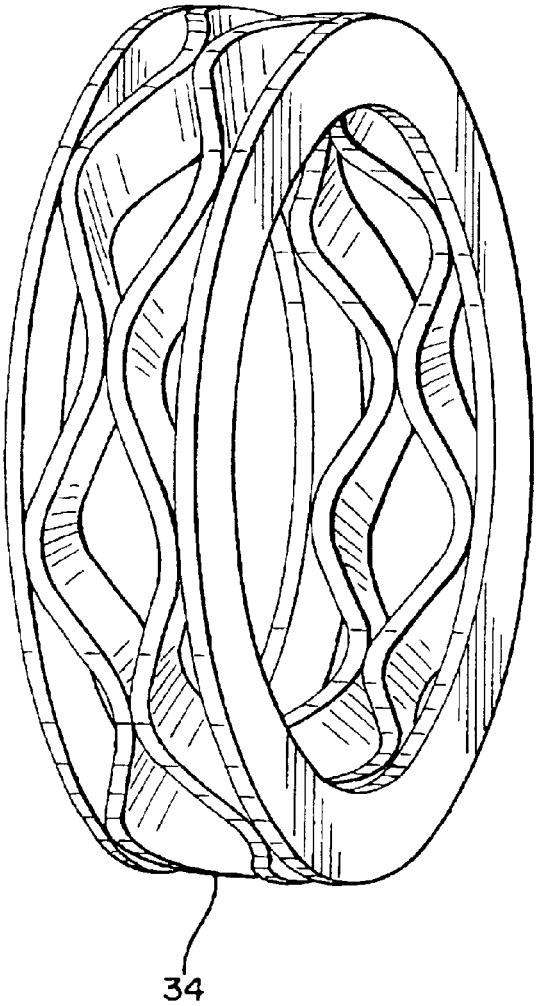
FIG. 6 is a perspective top view of the spring of the tongue element of the quick adjusting pliers device of FIG. 1.

Referring to FIG. 1, an exploded view of an embodiment in accordance with the quick adjusting pliers device of the present invention is shown. A top jaw 20 is integrally attached to a bottom handle 26*a*. The top jaw 20 has a slot 22 formed therein and has a series of ridges 24 formed on both sides of the slot 22 and above the bottom handle 26*a*. A bottom jaw 28 is integrally attached to a top handle 26*b* and has an opening 27 for receiving a pin 29. Pin 29 extends through an opening of a spring 34 (see FIG. 6), opening 40 of tongue element 32, opening 27 of bottom jaw 28, and slot 22. With head 30, pin 29 pivotally connects the top jaw 20, bottom jaw 28, tongue element 32 and spring 34. Tongue element 32 is biased by spring 34.

FIGS. 2–5 illustrate the structure and rocker shape of tongue element 32 from various views. Tongue element 32 includes an extending portion 35 that extends through slot 22. The extending portion 35 keeps the tongue element aligned with the upper jaw 20. One or more teeth 38 are provided on tongue element 32 for engaging one or more of the series of ridges 24. Portion 35 extends in between and beyond teeth 38 underneath the top surface of tongue element 32. In order to promote translation of the tongue element 32 and bottom jaw 28 towards the top jaw 20, ridges 24 are angled towards top jaw 20 while teeth 38 are angled away from top jaw 20. Tongue element 32 and bottom jaw 28 are thus able to freely translate towards the top jaw 20 while being prevented by the ridges 24 from translating away from the top jaw 20. Accordingly, tongue element 32 is moveable relative to the ridges 24 to allow for engagement or disengagement with said ridges 24.

Figure 7:
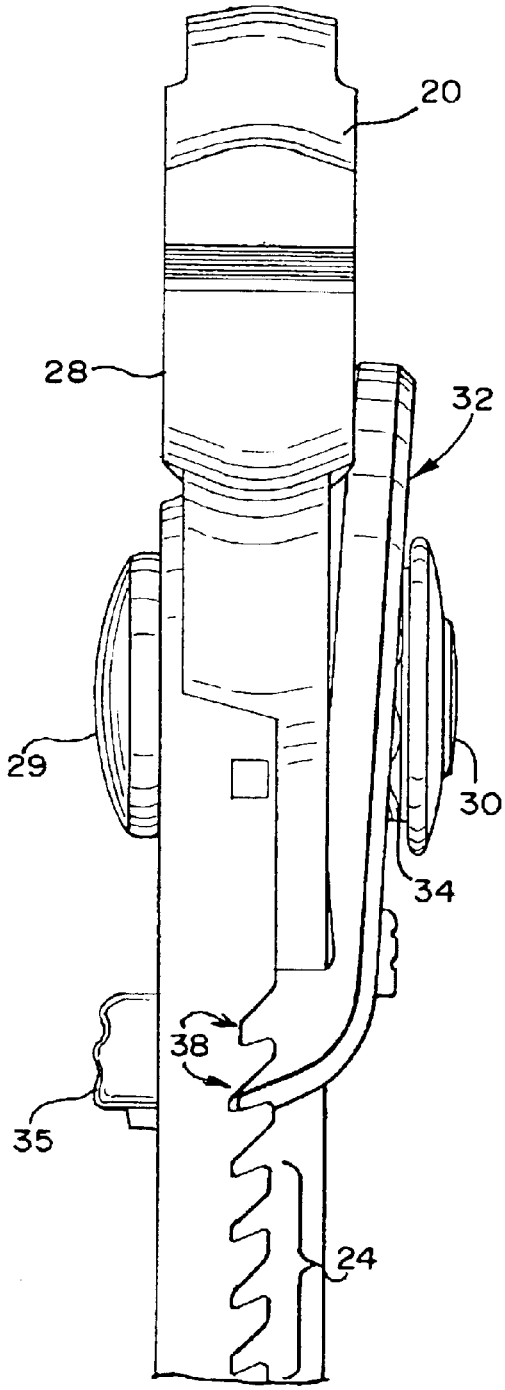
FIG. 7 is a left side view of the quick adjusting pliers device of FIG. 1, with the device in the closed position.
Figure 8:
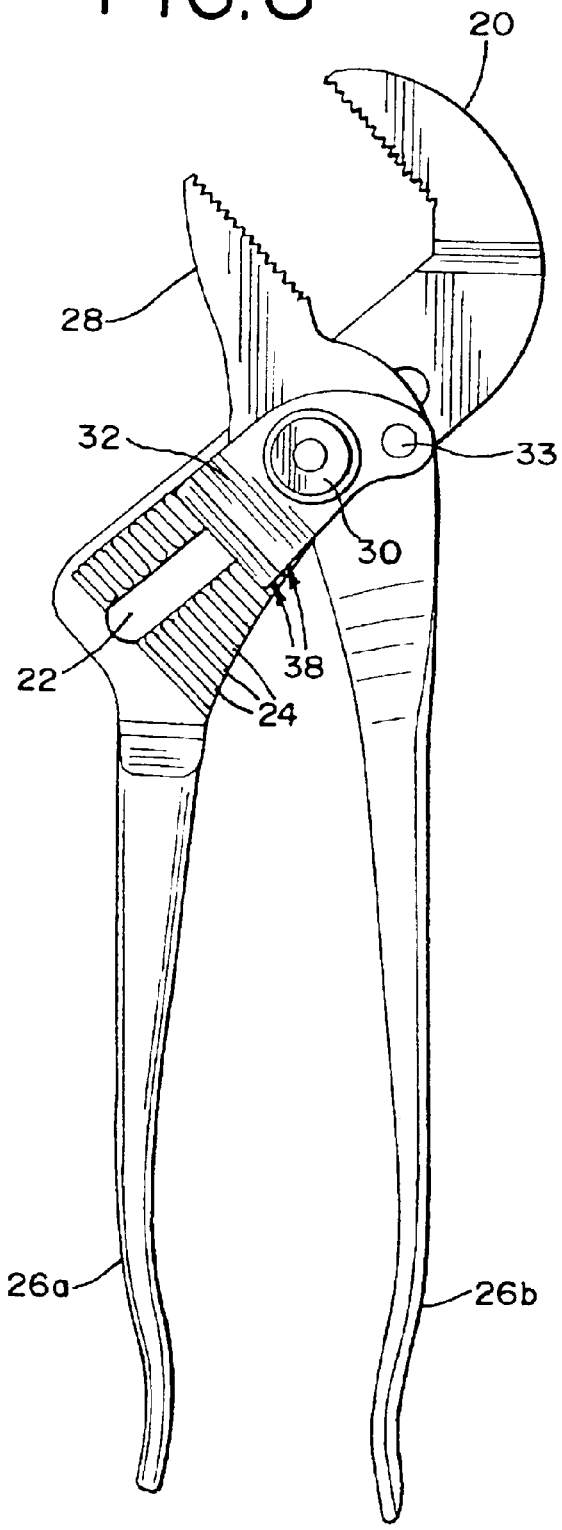
FIG. 8 is a front view of the quick adjusting pliers device of FIG. 1, with the device in an intermediate position of adjustment.
Figure 9:
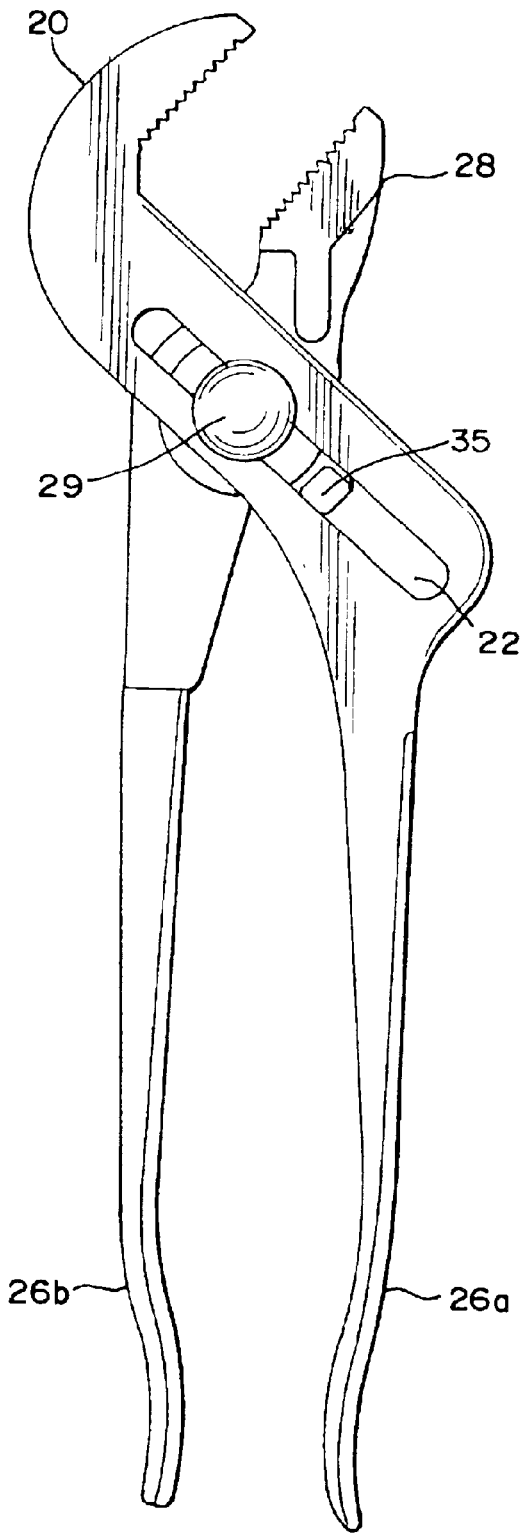
FIG. 9 is a back view of the quick adjusting pliers device of FIG. 1, with the device in an intermediate position of adjustment.

FIGS. 7–9 further illustrate the quick adjusting pliers device of FIG. 1. Ridges 24 are formed on both sides of the lower end of slot 22. As shown in FIG. 8, ridges 24 are straight in shape. However, curved ridges can also be used. Top jaw 20 and bottom jaw 28 pivot about a first axis that extends though a longitudinal axis of pin 29 and head 30. Tongue element 32 and bottom jaw 28 are moveable since tongue element 32 can be engaged and disengaged by ridges 24, as described above. With straight ridges, as shown, one or more teeth 38 can be used. With curved ridges, only one tooth 38 can be used.

As shown in FIG. 8, tongue element 32 includes a button 33. When pressed, button 33 pulls the teeth 38 of tongue element 32 out of the ridges 24. Thus, tongue element 32 pivots about a second axis that is perpendicular to the first axis so that bottom jaw 28 can move away from top jaw 20 and release an object. This allows the bottom jaw 28 to freely move towards or away from top jaw 20 to provide either a smaller or larger opening between the jaws of the device. Note that pressing extended portion 35 of the tongue element towards slot 22 pushes tongue element 32 out of the ridges 24 as well. Thus, pressing extended portion 35 also allows bottom jaw 28 to be moved towards or away from top jaw 20 to provide a smaller or larger opening between the jaws of the device.

In order for the jaws of the device to clamp an object, the teeth 38 of tongue element 32 engage a ridge 24 that corresponds to the size of the object being clamped. Bottom jaw 28 then pivots about pin 29, which is translationally fixed due to the engagement between the teeth of the tongue element and the correct ridge. When there is no object to be gripped and top jaw 20 and bottom jaw 28 contact one another, the tool can stay in this position, which allows for easy storage.

Figure 10:
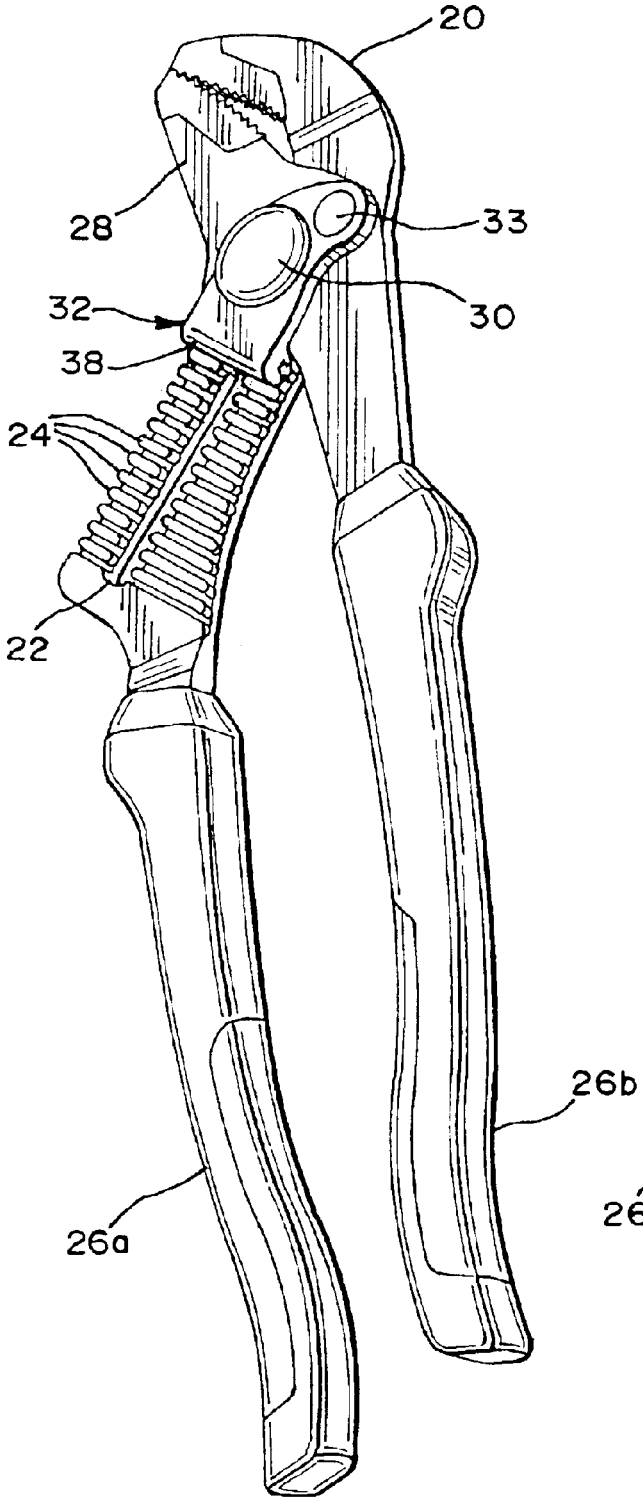
FIG. 10 is a front perspective view of a quick adjusting pliers device according to a first embodiment of the present invention, with the device in the closed position and with elastomeric handles.
Figure 11:
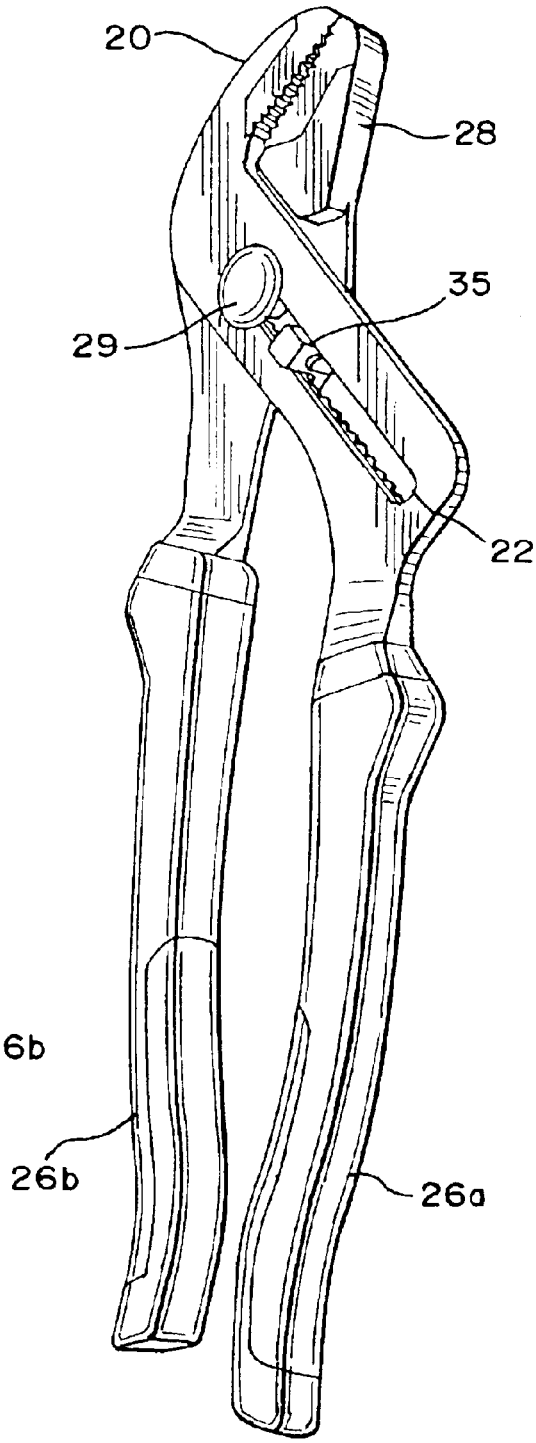
FIG. 11 is a back perspective view of the quick adjusting pliers device of FIG. 10, with the device in the closed position.

FIGS. 10–11 illustrate the first embodiment with the top jaw 20 and bottom jaw 28 of the device in the closed position. In addition, bottom handle 26*a* and top handle 26*b* have an elastomeric material fitted around their exteriors, making the handles slightly thicker.

Figure 12:
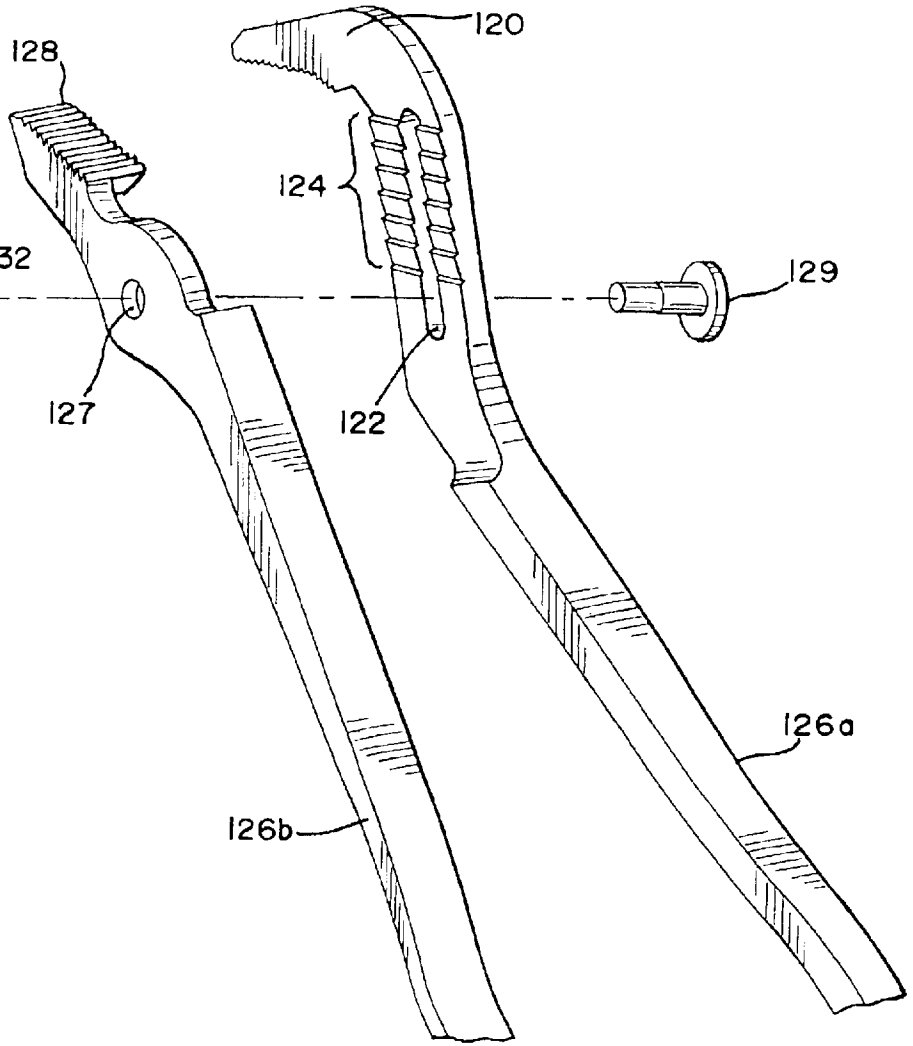
FIG. 12 is an exploded view of a quick adjusting pliers device according to a second embodiment of the present invention, with engagement of straight ridges above the pivot.
Figure 12:
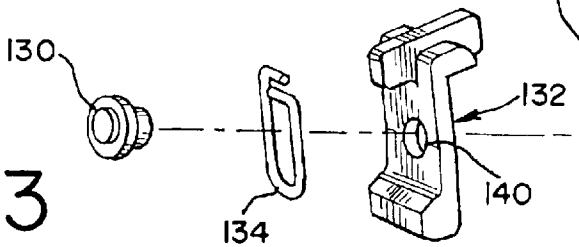
Figure 13:
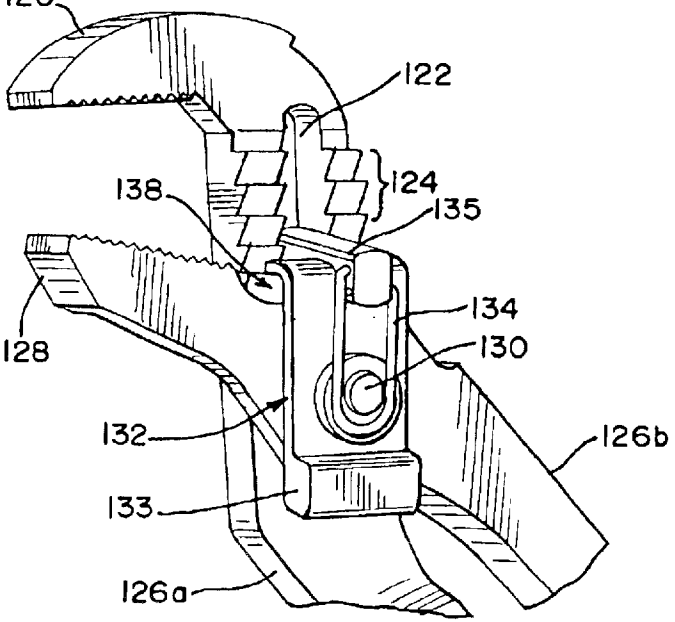
FIG. 13 is an enlarged perspective view of the quick adjusting pliers device of FIG. 12, with the device in the open position.

FIGS. 12–13 illustrate a second embodiment of the present invention. Ridges 124 are straight and located at the upper end of slot 122. However, curved ridges can also be used. Pin 129 extends through openings 127 and 140. Handles 126*a* and 126*b*, slot 122, pin 129 and head 130 are similar to, and function the same as corresponding items 26*a*, 26*b*, 22, 29 and 30, as described in the embodiment of FIGS. 1–9. Tongue element 132 has a somewhat different shape then tongue element 32 of the previous embodiment. Tongue element 132 has an extending portion 135 and teeth 138. With straight ridges, as shown, one or more teeth 38 can be used. With curved ridges, only one tooth 38 can be used. Tongue element 132 utilizes a raised surface 133 instead of a button to pull teeth 138 out of ridges 124 in a lever-like fashion. Spring 134 has a U-shape.

Figures 14, 15:
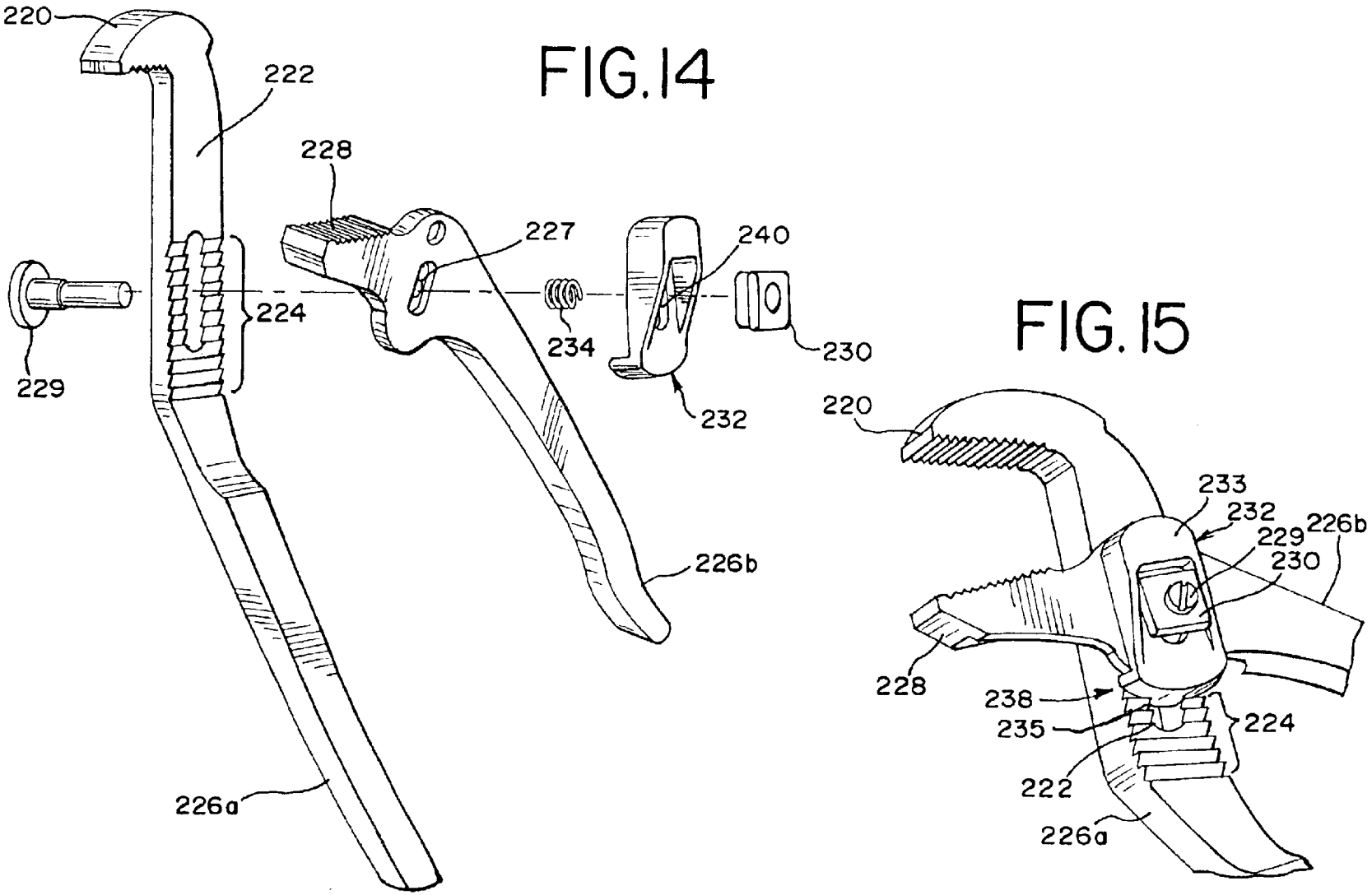
FIG. 14 is an exploded view of a quick adjusting pliers device according to a third embodiment of the present invention, with engagement of curved ridges below the pivot.
FIG. 15 is an enlarged perspective view of the quick adjusting pliers device of FIG. 14, with the device in an intermediate position.

FIGS. 14–15 illustrate a third embodiment of the present invention. Ridges 224 are curved and located at the lower end of slot 222. However, straight ridges can also be used. Pin 229 extends through openings 227 and 240. Handles 226*a* and 226*b*, slot 222, pin 229, and head 230 are similar to, and function the same as corresponding items 26*a*, 26*b*, 22, 29 and 30, as described in the embodiment of FIGS. 1–9. Tongue element 232 has an extending portion 235 and tooth 238. With curved ridges, as shown, only one tooth 238 can be used. With straight ridges, one or more teeth 238 can be used. Tongue element 232 utilizes a raised surface 233 instead of a button to pull tooth 238 out of ridges 224 in a lever-like fashion. Spring 234 has a coiled shape and operates in a manner similar to spring 34 of FIGS. 1–9.

Figure 16:
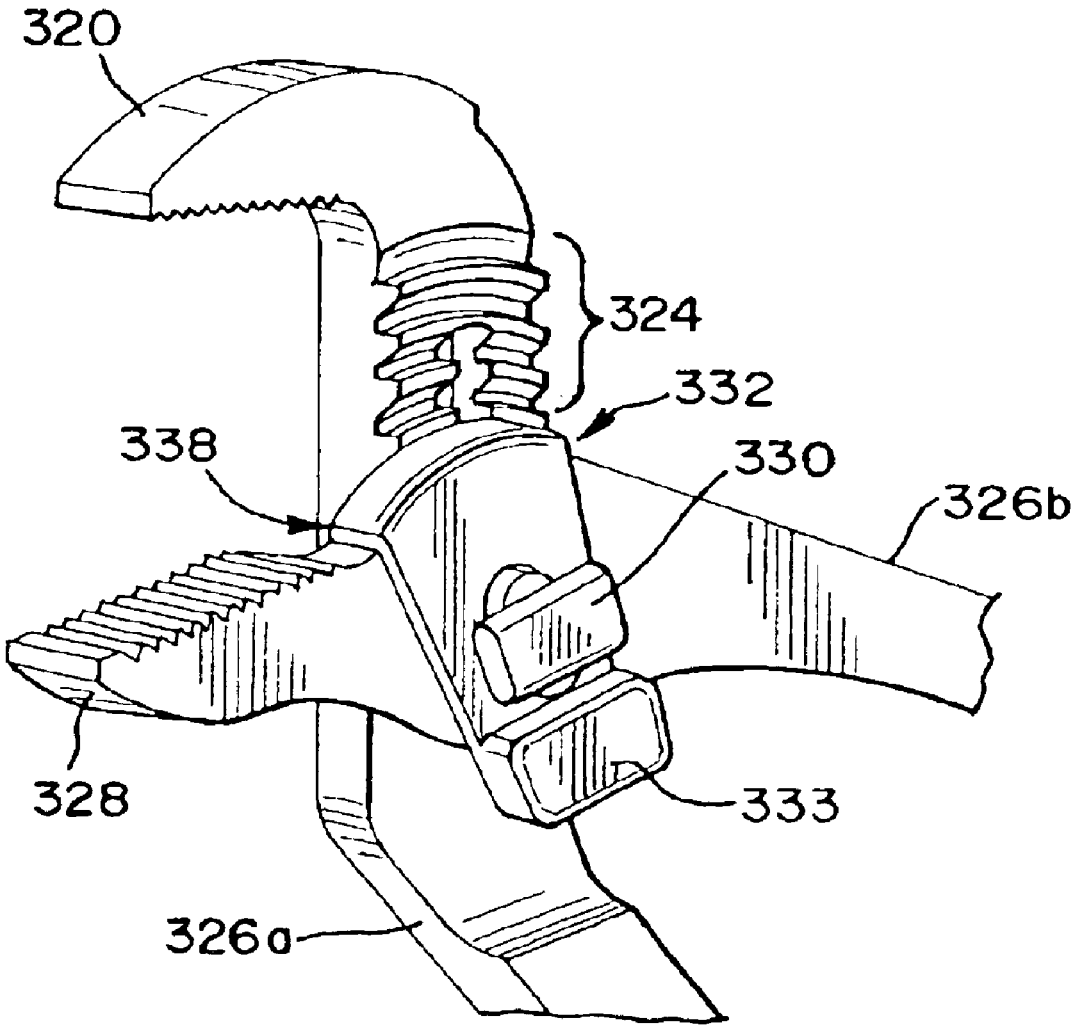
FIG. 16 is an enlarged perspective view of a quick adjusting pliers device according to a fourth embodiment of the present invention, with engagement of curved ridges above the pivot.

FIG. 16 illustrates a fourth embodiment of the present invention. Ridges 324 are curved and located at the upper end of slot 322. However, straight ridges can also be used. Handles 326*a* and 326*b*, slot 322, pin 329, and head 330 are similar to, and function the same as corresponding items 26*a*, 26*b*, 22, 29 and 30, as described in the embodiment of FIGS. 1–9. Tongue element 332 has an extending portion (not shown) and tooth 338. With curved ridges, as shown, only one tooth 38 can be used. With straight ridges, one or more teeth 38 can be used. Tongue element 332 utilizes a raised surface 333 instead of a button to pull tooth 338 out of ridges 324 in a lever-like fashion. A spring (not shown) used in any of the previous embodiments may be used in this fifth embodiment.

It is intended that the foregoing detailed description be regarded as illustrative rather than limiting and that it be understood that it is the following claims, including all equivalents, which are intended to define the scope of this invention.

What is claimed is:

1. A quick adjusting pliers device comprising:

a top jaw having a bottom handle, a slot and a series of ridges, wherein the ridges are located around the slot;

a pin that extends through the slot;

a tongue element having a first opening for receiving the pin; and a bottom jaw having a top handle and another opening for receiving the pin, wherein the tongue element engages one of the series of ridges, wherein the top jaw and bottom jaw pivot about a first axis that extends though a longitudinal axis of the pin, and wherein the tongue element is moveable relative to the ridges to allow for engagement or disengagement with said ridges, said tongue element pivots about a second axis that is perpendicular to the first axis.

2. The quick adjusting pliers device of claim 1 wherein the series of ridges are straight.

3. The quick adjusting pliers device of claim 1 wherein the series of ridges are curved.

4. The quick adjusting pliers device of claim 1 wherein the tongue element has a rocker shape.

5. The quick adjusting pliers device of claim 1 wherein the tongue element is based via a spring.

6. The quick adjusting pliers device of claim 1 wherein the ridges are located at the lower end of the slot.

7. The quick adjusting pliers device of claim 1 wherein the ridges are located at the upper end of the slot.

8. The quick adjusting pliers device of claim 1 wherein the bottom jaw can be moved away from the top jaw while a button on the tongue element is pressed.

9. The quick adjusting pliers device of claim 1 wherein the bottom jaw can be moved away from the top jaw while an extended portion of the tongue element is pressed.

10. A quick adjusting pliers device comprising:

a top jaw having a bottom handle, a slot and a series of ridges, wherein the ridges are located on said top jaw adjacent both sides of the slot, said ridges extending outside of said slot;

a pin that extends through the slot;

a tongue element having a first opening for receiving the pin; and a bottom jaw having a top handle and another opening for receiving the pin, wherein the tongue element engages one of the series of ridges, and wherein the bottom jaw is able to freely translate towards the top jaw.

11. The quick adjusting pliers device of claim 10 wherein the series of ridges are straight.

12. The quick adjusting pliers device of claim 10 wherein the series of ridges are curved.

13. The quick adjusting pliers device of claim 10 wherein the tongue element has a rocker shape.

14. The quick adjusting pliers device of claim 10 wherein the tongue element is biased via a spring.

15. The quick adjusting pliers device of claim 10 wherein the bottom jaw can be moved away from the top jaw while a thumb button on the tongue element is pressed.

16. The quick adjusting pliers device of claim 10 wherein the bottom jaw can be moved away from the top jaw while an extended portion of the tongue element is pressed.

17. The quick adjusting pliers device of claim 10, wherein the bottom jaw is prevented from translating away from the top jaw.

18. The quick adjusting pliers device of claim 10 wherein the ridges are located at the lower end of the slot.

19. The quick adjusting pliers device of claim 10 wherein the ridges are located at the upper end of the slot.

20. A method of clamping an object with a quick adjusting pliers device having a tongue element in the quick adjusting pliers device, comprising:

(a) opening a bottom jaw and a top jaw of a quick adjusting pliers device to a first position so that a tongue element engages a ridge formed in the quick adjusting pliers device;

(b) placing an object between the bottom jaw and the top jaw;

(c) pivoting the bottom jaw and the top jaw about a first axis so as to grip the object; and (d) pivoting the tongue element about a second axis that is perpendicular to the first axis so that the bottom jaw can move away from said top jaw and release the object.

21. The method of claim 20 wherein the ridge is straight.

22. The method of claim 20 wherein the ridge is curved.

23. The method of claim 20 further comprising the step of releasing the bottom jaw and top jaw back to the first position.

24. The method of claim 20 wherein the tongue element has a racker shape.

25. The method of claim 20 wherein the tongue element is biased via a spring.

* * * * *

UNITED STATES PATENT AND TRADEMARK OFFICE

CERTIFICATE OF CORRECTION

PATENT NO. : 7,100,480 B2
APPLICATION NO. : 10/406621
DATED : September 5, 2006
INVENTOR(S) : Engvall et al.

It is certified that error appears in the above-identified patent and that said Letters Patent is hereby corrected as shown below:

On Title Page, Item (57)
In the Abstract, line 9, change “though” to --through--
Column 4, Claim 1, line 11 change “though” to --through--
Column 6, Claim 24, line 9, change “racker” to --rocker--

Signed and Sealed this

Twenty-eighth Day of November, 2006

JON W. DUDAS
*Director of the United States Patent and Trademark Office*